US006704422B1

(12) United States Patent
Jensen

(10) Patent No.: US 6,704,422 B1
(45) Date of Patent: Mar. 9, 2004

(54) METHOD FOR CONTROLLING THE DIRECTIONALITY OF THE SOUND RECEIVING CHARACTERISTIC OF A HEARING AID A HEARING AID FOR CARRYING OUT THE METHOD

(75) Inventor: Lars Baekgaard Jensen, Farum (DK)

(73) Assignee: Widex A/S, Vaerloese (DK)

( * ) Notice: Subject to any disclaimer, the term of this patent is extended or adjusted under 35 U.S.C. 154(b) by 412 days.

(21) Appl. No.: 09/696,264

(22) Filed: Oct. 26, 2000

Related U.S. Application Data

(63) Continuation-in-part of application No. 09/445,485, filed as application No. PCT/EP99/04375 on Jun. 24, 1999.

(51) Int. Cl.[7] ..... H04R 25/00

(52) U.S. Cl. ..... 381/313; 381/312

(58) Field of Search ..... 381/23.1, 92, 312, 381/313, 315, 320, 321, 328, 330, 356, 357, 91, 122, FOR 128, FOR 131, FOR 133, FOR 134, FOR 142, FOR 129

(56) References Cited

U.S. PATENT DOCUMENTS

| | | | | |
|---|---|---|---|---|
| 4,399,327 A | | 8/1983 | Yamamoto et al. | |
| 4,703,506 A | | 10/1987 | Sakamoto et al. | |
| 5,033,090 A | | 7/1991 | Weinrich | |
| 5,121,426 A | | 6/1992 | Baumhauer, Jr. et al. | |
| 5,128,566 A | | 7/1992 | Killion et al. | |
| 5,214,709 A | | 5/1993 | Ribic | |
| 5,463,694 A | * | 10/1995 | Bradley et al. | 381/92 |
| 5,483,599 A | * | 1/1996 | Zagorski | 381/327 |
| 5,524,056 A | | 6/1996 | Killion et al. | |
| 5,757,933 A | | 5/1998 | Preves et al. | |
| 6,339,647 B1 | * | 1/2002 | Andersen et al. | 381/312 |
| 6,389,142 B1 | * | 5/2002 | Hagen et al. | 381/313 |

FOREIGN PATENT DOCUMENTS

| | | |
|---|---|---|
| EP | 0466676 A2 | 1/1992 |
| EP | 0483701 A2 | 5/1992 |
| JP | 5964994 | 4/1984 |

* cited by examiner

*Primary Examiner*—Curtis Kuntz
*Assistant Examiner*—Brian Ensey
(74) *Attorney, Agent, or Firm*—Sughrue Mion, PLLC

(57) ABSTRACT

Change over of the sound receiving characteristic of a hearing aid having spaced apart first and second microphone means (Fmic, Bmic) between the omnidirectional characteristic and a directional characteristic is effected by controlled attenuation and time or phase delay of signals derived from the signals ($X_{front}$, $X_{back}$) from the first and second microphone means before forming and overall combined signal (Y) to be supplied to the hearing aid signal processor, whereby the overall combined signal (Y) is determined by $$Y=X_{front}*(1-\text{omni}*e^{-j\omega T})+X_{back}*(\text{omni}-e^{-j\omega T}),$$

where omni is an adjustable attenuation control parameter preferably in the range $0 \leqq \text{omni} \leqq 1$ and T is a time delay corresponding to the acoustical delay between the first and second microphone means.

In result, the change between the omnidirectional characteristic and any desired form of the directional characteristic is effected as a smooth change-over substantially without affecting phase relationship, time delay and amplitude characteristic of the hearing aid.

35 Claims, 13 Drawing Sheets

METHOD FOR CONTROLLING THE DIRECTIONALITY OF THE SOUND RECEIVING CHARACTERISTIC OF A HEARING AID A HEARING AID FOR CARRYING OUT THE METHOD

This is a Continuation-in-Part of application Ser. No. 09/445,485 filed Dec. 7, 1992, which is a 371 of PCT/EP99/04375, filed Jun. 24, 1999.

BACKGROUND OF THE INVENTION

The present invention relates to a method for controlling the directionality of the sound receiving characteristic of a hearing aid comprising spaced apart first and second sound receiving microphone means, a signal processor for processing signals supplied by said microphone means and an output transducer for emission of sound signals in response to output signals from the signal processor, said method comprising the steps of changing over said sound receiving characteristic between an omnidirectional characteristic and a directional characteristic and, when operating the hearing aid with said directional characteristic, combining the signals supplied by said first and second microphone means into an overall combined signal, which is supplied to the signal processor, an adjustable time or phase delay being imposed on at least one signal.

Hearing aids having a directional sound receiving characteristic are useful to improve speech perception in noisy environments, where human speech may be received simultaneously from different directions, as is the case e.g. in the noise environment frequently referred to as cocktail party noise.

With a directional sound receiving characteristic, e.g. in the shape of a cardioid or super cardioid characteristic, the speech perception in a hearing aid is improved by reduced reception of sound coming from the back of the user, while maintaining the level of sound coming from the area in front of the user.

On the other hand, in environments with only a low noise level or no significant speech signals the hearing aid user will normal prefer an omnidirectional or spherical sound receiving characteristic offering the same perception of sound irrespective of the direction, from which it arrives.

As will be further explained in the following a prior art hearing aid of the kind defined above, offering the possibility of changing the sound receiving characteristic between an omnidirectional characteristic and a directional characteristic of varying shape has been disclosed in U.S. Pat. No. 5,757,933.

With this prior art hearing aid operating with an omnidirectional characteristic only the signal from the first microphone facing the area in front of the user is supplied to the signal processor. By manual operation of a switch a signal derived from the second microphone facing the rear of the user and subjected to inversion followed by adjustable phase delay and adjustable attenuation is combined via a summing node with the signal derived from the first microphone.

When the sound receiving characteristic in a hearing aid of this type is changed or changes from the omnidirectional to a directional shape, the arrival time of the sound changes during the transition. This change of phase or time delay may become confusing in a binaural hearing aid system using a pair of separate hearing aids operating with independent and automatic change of the sound receiving characteristic. When phase or arrival times change differently in the two hearing aids this will degrade or deteriorate the user's ability to locate the various sound sources in the surrounding space and the advantage of a binaural hearing aid system will be degraded.

Furthermore, the phase and time relationship in a hearing aid degrades the quality of the sound perceived by the user. It may sound like the result of a Doppler-effect.

At the same time, in hearing aids of this type also the amplitude characteristic will change during transition between the omnidirectional and a directional characteristic, e.g. from a flat response to a response in which the amplitudes of higher frequencies will be increased. This increase may be in the area of 6 dB/octave. This results in the serious problem, that hearing aids of this type can not be perfectly fitted with an optimum transfer characteristic for both the omnidirectional and the directional characteristic.

SUMMARY OF THE INVENTION

On this background, it is the object of the present invention to provide a method of the kind defined, in which the deficiencies of the prior art hearing aid are remedied by effecting a smooth change-over between the omnidirectional characteristic and any directional characteristic substantially without changing the phase relationship or time delay and the amplitude characteristic of the signals. The change-over between the omnidirectional characteristic and a directional characteristic and vice versa may be controllable or even automatic.

According to the invention this object is achieved by a method of the kind defined, which is characterized in that said change-over of the sound receiving characteristic from the omnidirectional characteristic to the directional characteristic and vice versa is effected by controlled attenuation and time or phase delay of signals deriverd from both of the signals ($X_{front}$, $X_{back}$) from the first and second microphone means before forming said overall combined signal (Y), using an adjustable attenuation control parameter (omni) and a delay (T), whereby said overall combined signal (Y) is determined by $$Y=X_{front}*(1-\text{omni}*e^{-j\omega T})+X_{back}*(\text{omni}-e^{-j\omega T}),$$

to change over the hearing aid between said omnidirectional characteristic and any desired form of said directional characteristic as a smooth change-over substantially without affecting phase relationship, time delay and amplitude characteristic of the hearing aid.

For carrying out the method as defined the invention further relates to a hearing aid with controllable directionality of its sound receiving characteristic, comprising spaced apart first and second sound receiving microphone means, a signal processor for processing signals supplied by said microphone means and an output transducer for emission of sound signals in response to output signals from the signal processor, and further comprising change-over control means for change over of the sound receiving characteristic between an omnidirectional characteristic and a directional characteristic and combining means for combination of the signal from the first and second microphone means to provide an overall combined signal supplied to the signal processor, when operating the hearing aid with said directional characteristic, and adjustable time or phase delay means being provided for producing a phase-delayed modification of at least one signal.

According to the invention this hearing aid is characterized in that said change-over control means comprises controllable attenuation means and controllable time or phase delay means acting on signals derived from the signals from both of the first and second microphone means, respectively, said attenuation and phase delay means being controlled for forming said overall combined signal (Y) using an adjustable attenuation control parameter (omni) and a delay (T), whereby said overall combined signal (Y) is determined by $$Y=X_{front}*(1-\text{omni}*e^{-j\omega T})+X_{back}*(\text{omni}-e^{-j\omega T}),$$

to change over the hearing aid between said omnidirectional characteristic and any desired form of said directional characteristic as a smooth change-over substantially without affecting phase relationship, time delay and amplitude characteristic of the hearing aid.

BRIEF DESCRIPTION OF THE DRAWINGS

In the following the invention will be further explained with reference to the accompanying drawings, in which.

DETAILED DESCRIPTION OF THE INVENTION

Figure 1:
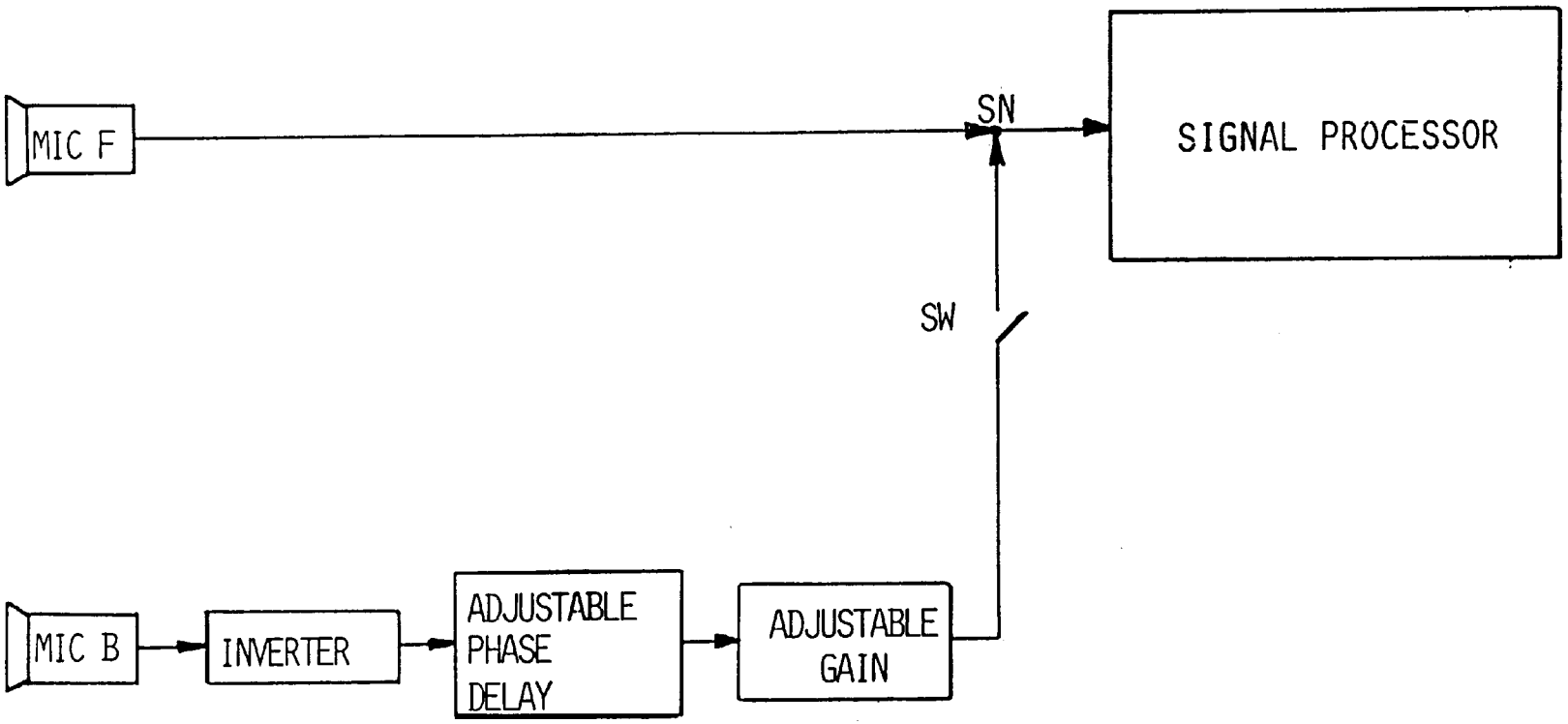
FIG. 1 PRIOR ART
FIG. 1 is a schematic block diagram of the prior art hearing aid of U.S. Pat. No. 5,757,933.

In the prior art hearing aid in FIG. 1 two non-directional microphone circuits including a front microphone MICF and a back microphone MICB. Whereas the output signal from the front microphone MICF is supplied directly to the hearing aid signal processor via a summing node SN, the signal from the back microphone is supplied to the summing node SN via an inverter, an adjustable phase delay circuit and an attenuator with adjustable gain only by closure of a manually operated switch SW, whereby the sound receiving characteristic of the hearing is changed from the omnidirectional characteristic of front microphone MICF to a directional characteristic of varying shape.

The combined signal Y formed at the summing node SN with switch SW closed and supplied to the signal processor will thus be related to the signals $X_{front}$ and $X_{back}$ from front and back microphones MICF and MICB, respectively, by the relation $$Y=X_{front}-X_{back}*\text{omni}*e^{-j\omega T},$$

where the adjustable parameter omni represents the adjustable gain of the attenuator, whereas T represents the adjustable time delay corresponding to the difference in arrival time for sound signals received by the front and back microphones MICF and MICB, respectively.

Figure 2:
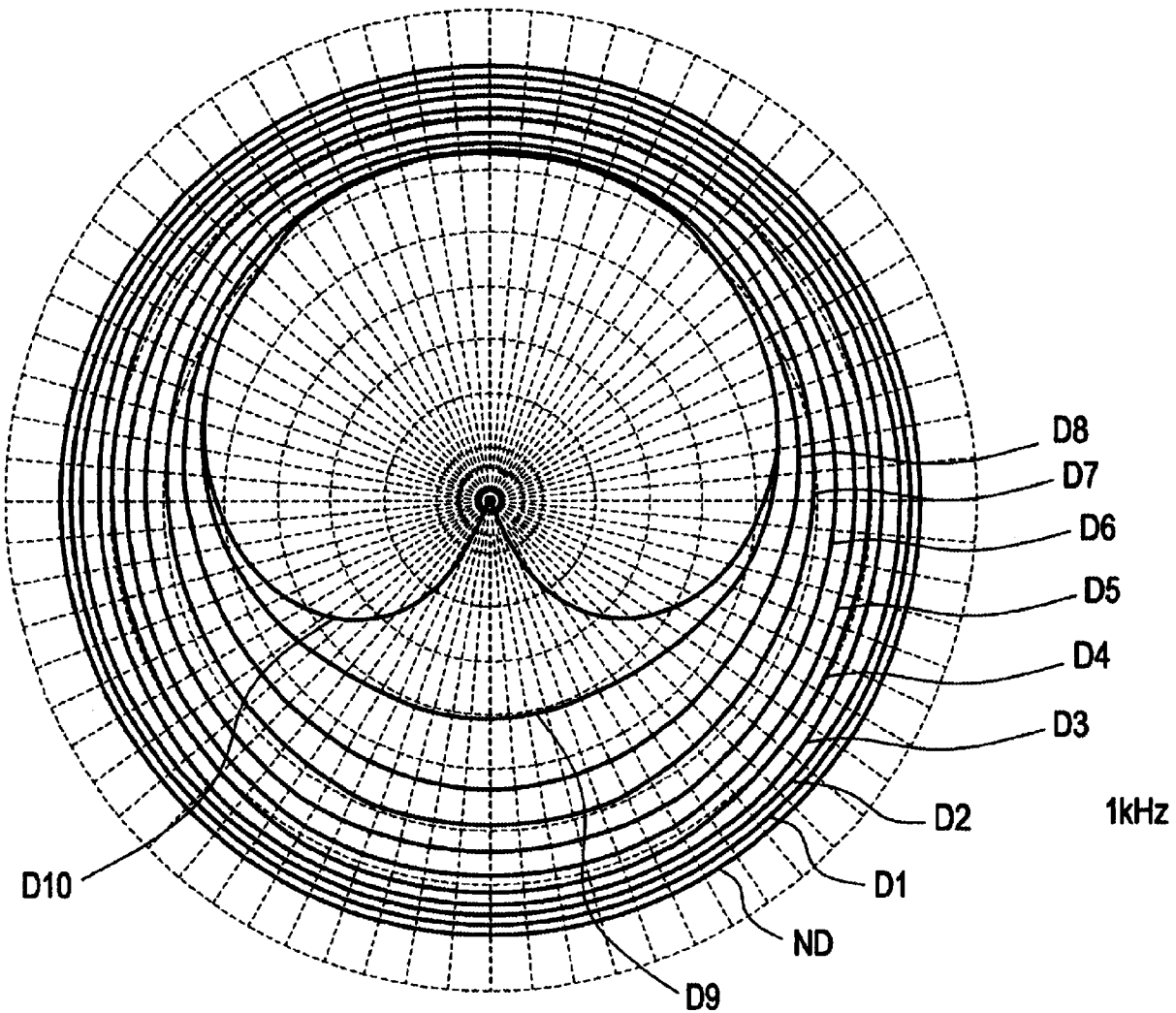
FIGS. 2–5 are graphic representations illustrating variation of the sound receiving characteristic of the hearing aid in FIG. 1 between the omnidirectional characteristic and different directional shapes and concurrent variation of amplitude characteristics of the front and back microphones used therein.
Figure 3:
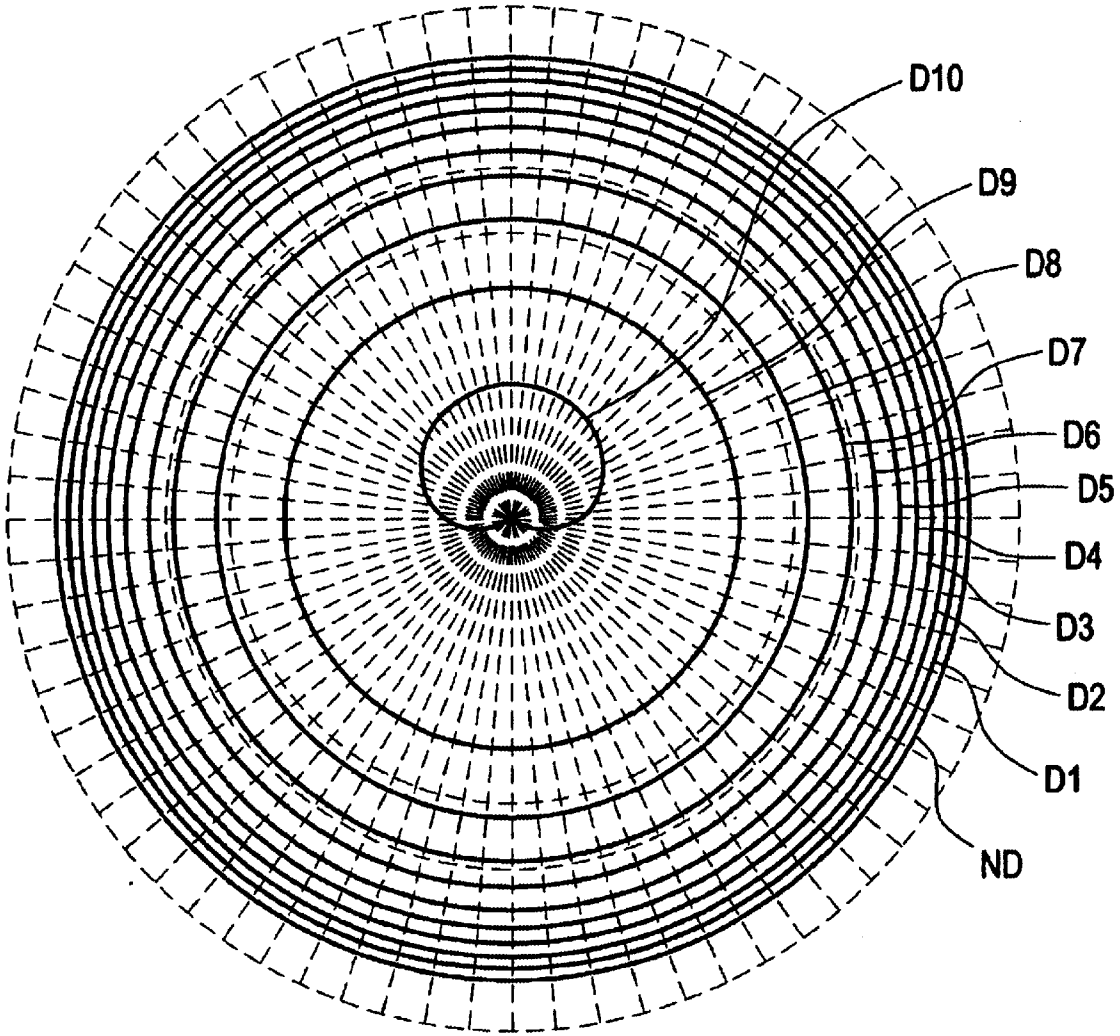
Figure 4:
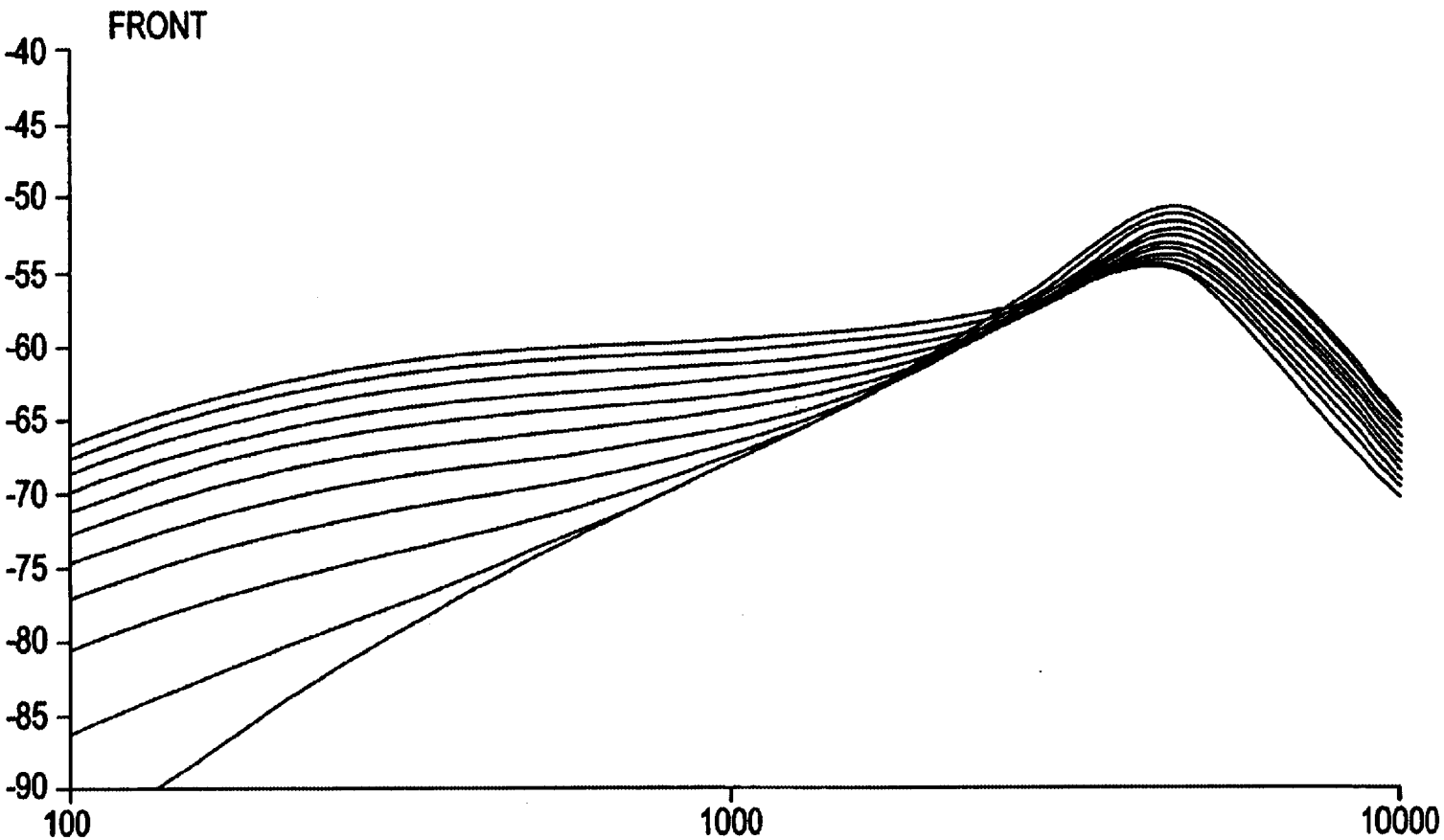
Figure 5:
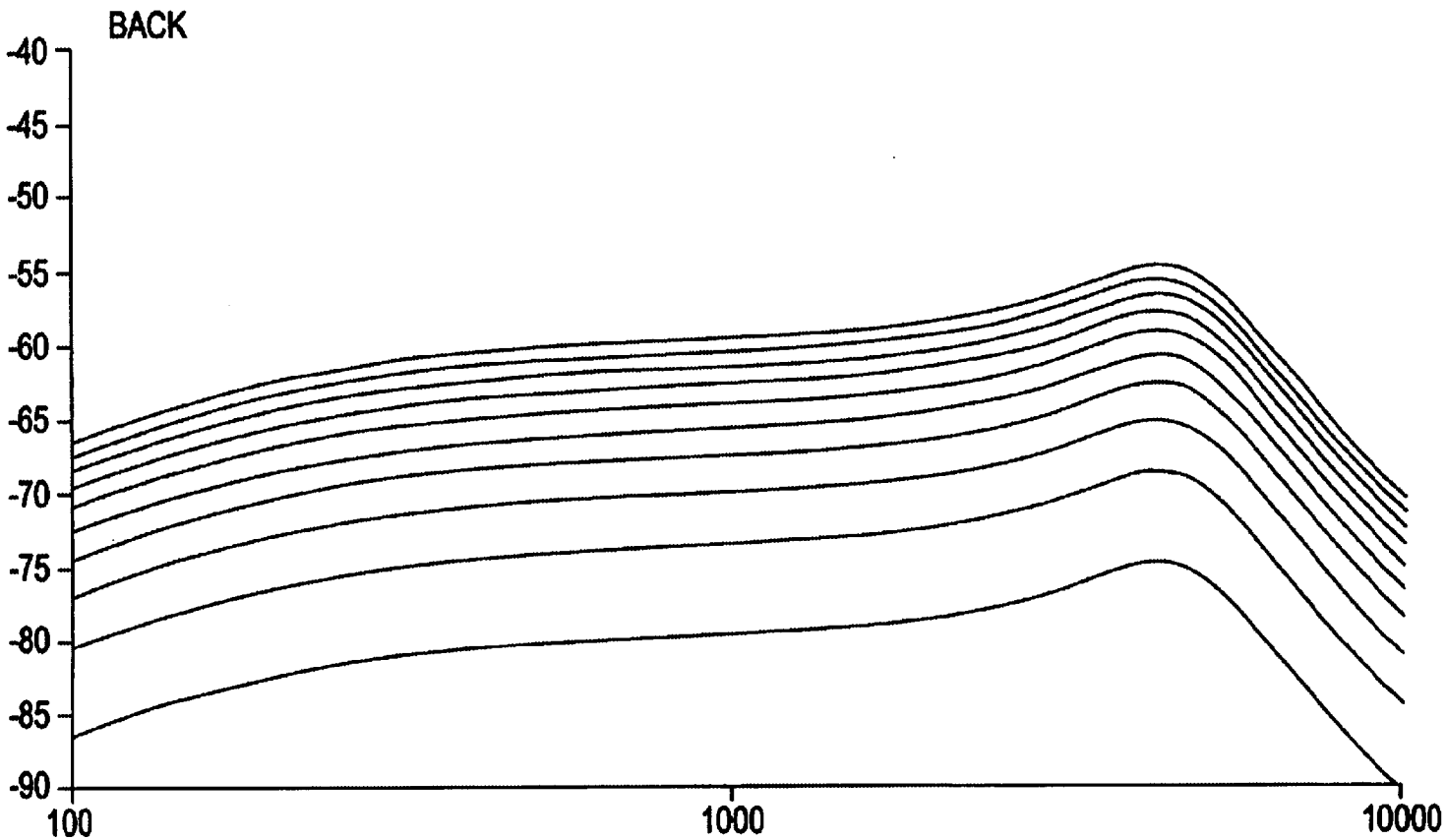

The graphic representations in FIGS. 2 and 3 illustrate the variation of the sound receiving characteristic of the hearing aid in FIG. 1 from the omnidirectional shape ND and various directional shapes D1 to D10 ranging from weak cardioid to super cardioid form for values of the adjustable parameter omni ranging from 0 to 1, measured at 1 kHz and 100 Hz, respectively, whereas the graphic representations in FIGS. 4 and 5 show the variation in the amplitude characteristics of the signals received from the areas in front and back of the hearing aid, respectively, for correspondingly varying values of the parameter omni.

As will appear from these representations the change-over between the omnidirectional characteristic and the various shapes of directional characteristic results in this prior art hearing aid not only in the desired gradual reduction in gain or amplitude response for the signals received from the area behind the user, but is accompanied also by a significant change in gain or amplitude response for the signals received from the area in front of the user. In consequence thereof an adjustment or fitting of the hearing to compensate for a users specific hearing impairment for listening in quiet surroundings, where use of the omnidirectional characteristic is preferred, will not provide an optimum compensation, when a change over is made to a directional characteristic, e.g. for use of the hearing aid in a more noisy sound environment, such as a party.

Figure 6:
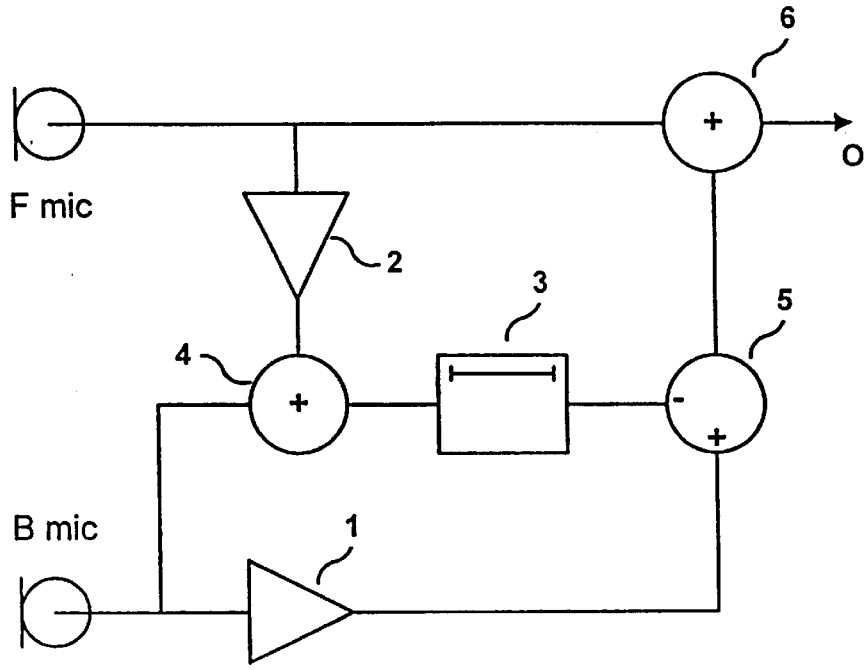
FIG. 6 shows a schematic arrangement of the front end of a first embodiment of a hearing aid according to the present invention.

FIG. 6, shows, in principle, the front end of a first embodiment of a hearing aid according to the inventions including a change-over controller for controlling change of the directionality of sound receiving characteristic of the hearing aid from the omnidirectional characteristic to a directional characteristic and vice versa. This change may be effected as a switch-over or as a gradual and smooth change-over.

The front end of the hearing aid comprises at least two microphone circuits, i.a. a front microphone Fmic and a back microphone Bmic and possibly optional preprocessing circuits for the electrical output signals from the microphones. The distance between the two microphones may be as small as 1 mm or as wide as a few cm.

The front end further contains at least two controllable amplifiers or attenuators 1 and 2, at least one time or phase delay device 3 and at least three combining circuits 4, 5 and 6. It is to be understood that the combining circuits may contain positive as well as negative input terminals, so as to form adding or subtraction operations or combinations thereof.

In the structure, the back microphone Bmic is connected to the controllable amplifier or attenuator 1 and to a first adding circuit 4.

The front microphone Fmic is connected directly to the controllable amplifier or attenuator 2 and to a second adding circuit 6. The output of the controllable amplifier or attenuator 2 is further connected directly to a second input of the first adding circuit 4, whereas the output of the controllable amplifier 1 is directly connected to a positive input of a subtraction circuit 5.

Between the output of the first adding circuit 4 and the negative input of the subtraction circuit 5 a preferable controllable delay device 3 is included.

In the following description the adding and subtracting circuits will generally be referred to as combining circuits.

In operation, sounds from the environment of the hearing aid is picked up both by the front microphone Fmic and the back microphone Bmic. The distance between the two microphones may be as small as 1 mm and as wide as a few cm.

The output signal of the front microphone Fmic is supplied to the combining circuit 6. The output signal of the back microphone Bmic is supplied to the controllable attenuator or controllable amplifier 1, the gain of which may be controllably changed from zero to one, i.e. from no amplification to full amplification. This change-over may be effected as a switch-over or as a controlled gradual change. This means that any amplification between zero and one may be controllably achieved.

The output signal, if any, of the front microphone Fmic is also supplied to a controllable attenuator or amplifier 2, the amplification of which may controllably be changed from zero to one, i.e. from no amplification to full amplification. Also in this case the change-over may be effected as a switch-over or as a gradual controlled change. This means that any amplification between zero and one may be achieved.

The output signal, if any, of the controllable attenuator or amplifier 2 is supplied to a second input of the combining circuit 4. The output signal, if any, of combining circuit 4 is supplied to the controllable delay device 3, the delay of which may be controlled from as small as 1 $\mu$s up to 1000 $\mu$s or more.

The output signal, if any, of delay device 3 is supplied to the negative input of combining circuit 5, the output of which is supplied to the second input of the combining circuit 6.

Thereby, the output signal of the front microphone Fmic may be attenuated in attenuator or controllable amplifier 2 before it is added to the undelayed output signal of the back microphone Bmic in the combining circuit 4, the output signal of which is then delayed in delay device 3 before being supplied to the combining circuit 5. The controllable delay of delay device 3 will usually have the same value as the acoustical delay between the arrival times of sounds at the front microphone Fmic and at the back microphone Bmic. Preferably this delay is also adjustable and/or controllable.

Additionally, the output signal of the attenuator or controllable amplifier 1 is supplied to the positive input of the combining circuit 5. In this combining circuit the delayed output signal of delay device 3 is subtracted from the attenuated output signal of amplifier or attenuator 1. The output signal of the combining circuit 5 is supplied, as a processed signal to the combining circuit 6. The output signal of the combining circuit 6 is then used as an input signal for further processing in the remaining components of the hearing aid such as the signal processor, which need not to be described here.

The remaining parts of the hearing aid may as known in the art, comprise more than one signal processing channel having, and with such a structure either a common change-over controller or a separate controller for each channel may be provided.

As further known in the art, the output signals of both microphones Fmic and Bmic may advantageously be converted into a digital representation before being supplied to the change-over controller with its components 1 to 6.

The function of the circuit in FIG. 6 is as follows:

For the directional mode of operation the signal transfer of the controllable attenuators 1 and 2 is set at zero, i.e. no signal is transferred.

The output signal of the front microphone Fmic is directly supplied to the second adding circuit 6. The output signal of the back microphone Bmic is supplied via the first adding circuit 4 and delay device 3 to the negative input of the subtraction circuit 5, where the signal changes its polarity. The output signal of the subtraction circuit S is then supplied to a second input of the second adding circuit 6. Thus, the delayed signal from the back microphone Bmic is subtracted from the undelayed output signal of the front microphone Fmic.

The directional front characteristic may then be created by adjusting the delay T of the delay device to be the same as the acoustical delay A between the back microphone Bmic and the front microphone Fmic. With this delay the signals, that are first received at the back microphone Bmic and are later received at the front microphone Fmic, are then suppressed in the adding circuit 6, where the delayed signal of the back microphone is subtracted from the output signal of the front microphone.

This mode of operation results in an output signal from adding circuit 6, which is the result of the subtraction of the delayed output signal of the back microphone Bmic from the output signal of the front microphone Fmic, thus cancelling sound coming directly from the back of the user.

By adjusting T<A, sound coming partly from the side of the user is cancelled, the direction of the cancelling effect is controlled by the ratio of T/A.

For the omnidirectional mode of operation both attenuators 1 and 2 are set for a full signal transfer.

The output signals from the front microphone Fmic and the back microphone Bmic are supplied to the first adding circuit 4, where they are combined and supplied via delay device 3 to the subtraction circuit 5, where the combined and delayed signal is subtracted from the output signal of the back microphone Bmic.

The output signal of the subtraction circuit 5 is then supplied to the second adding circuit 6, where it is combined with the undelayed output signal of the front microphone Fmic. The addition of these signals creates the omnidirectional characteristic. This mode of operation results in an output signal from the adding circuit 6, which is generated by the addition of the signals from the front and back microphones from which the delayed front and back microphone signals are subtracted.

The sound signals received at the two microphones differ with respect to their arrival time at the respective microphones from a source, the distance of which is different for the two respective microphones.

This difference is the acoustical delay A and the relationship between the sound signals $X_{front}$ and $X_{back}$ received at the front and back microphones, respectively, may be generally expressed as $$X_{back}=X_{front}*e^{-j\omega A},$$

where $e^{-j\omega A}$ is the acoustical delay for the actual direction to the sound source.

The combined signal Y from adding circuit 6 is $$Y=X_{front}*(1-omni*e^{-j\omega T})+X_{back}*(\text{omni}-e^{-j\omega T})$$

where omni is an adjustable parameter controlling attenuators 1 and 2 and having preferably a value in the range from 0 to 1, i.e. the lower limit omni=0 means no signal transfer through attenuators 1 and 2, whereas the upper limit omni=1 means maximum signal transfer through attenuators 1 and 2.

Although the invention is not limited thereto the parameter omni should preferably be substantially the same for both attenuators 1 and 2.

If the full directional mode of operation is chosen with omni=0, then the combined signal Y becomes $$Y=X_{front}*(1-e^{-j\omega(A+T)})$$

If the delay T is selected equal to the delay A directly from the back microphone to the front microphone in the directional mode of operation, then the part of the sound signal X coming directly from the back of the user is suppressed to the maximum extent and a directional characteristic known as a cardioid characteristic is achieved.

The signal process described so far is preferably performed as a digital process in the time or frequency domain. If processing in the frequency domain is employed, it is advantageous to use microphone circuits, which are capable of generating a delayed microphone output signal in combination with a non-delayed microphone output signal. Such microphone circuits are described in applicants' U.S. Pat. No. 6,339,647.

Figure 7:
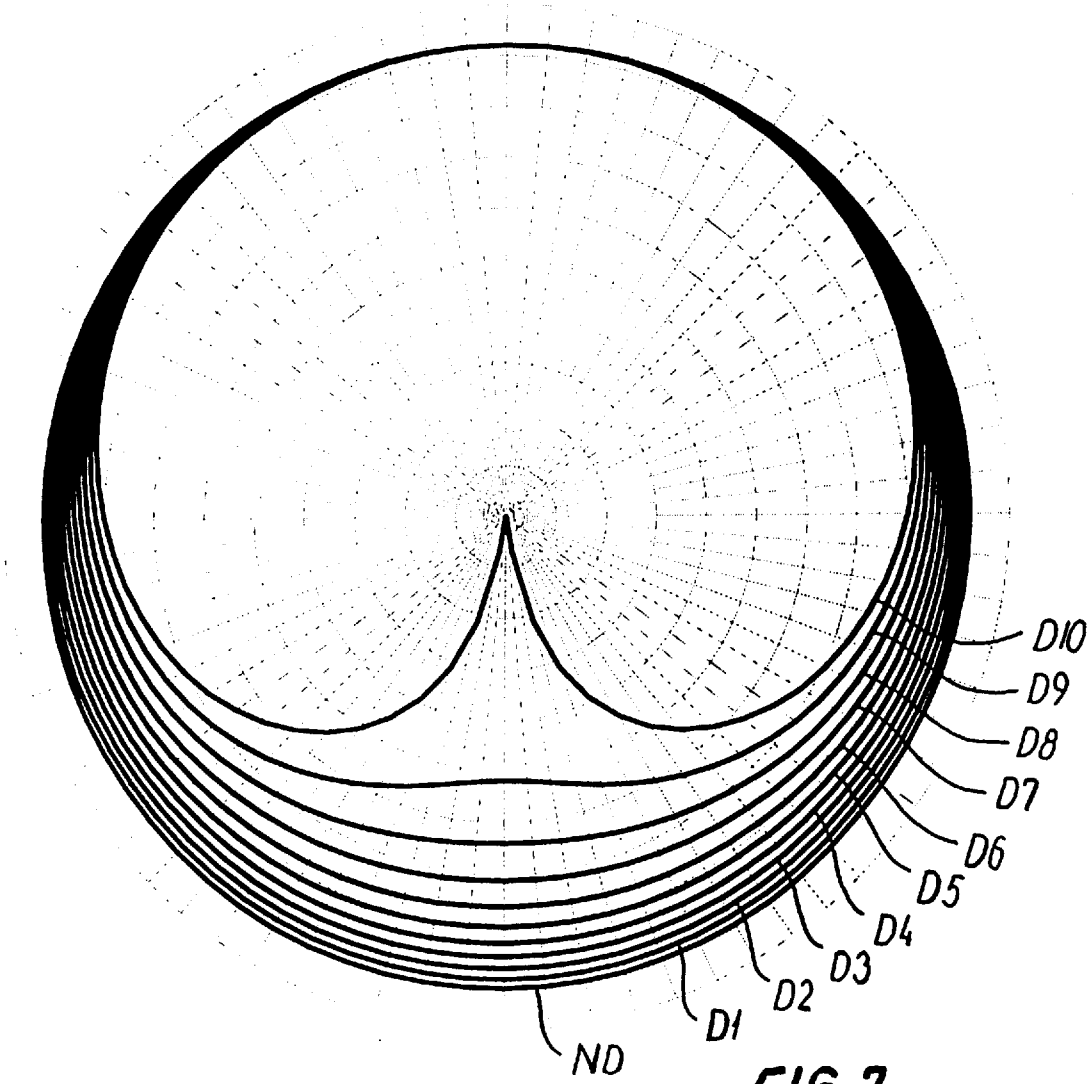
FIGS. 7 to 10 are graphic representation corresponding to the representations in FIGS. 2 to 5 with respect the hearing aid shown in FIG. 6.
Figure 8:
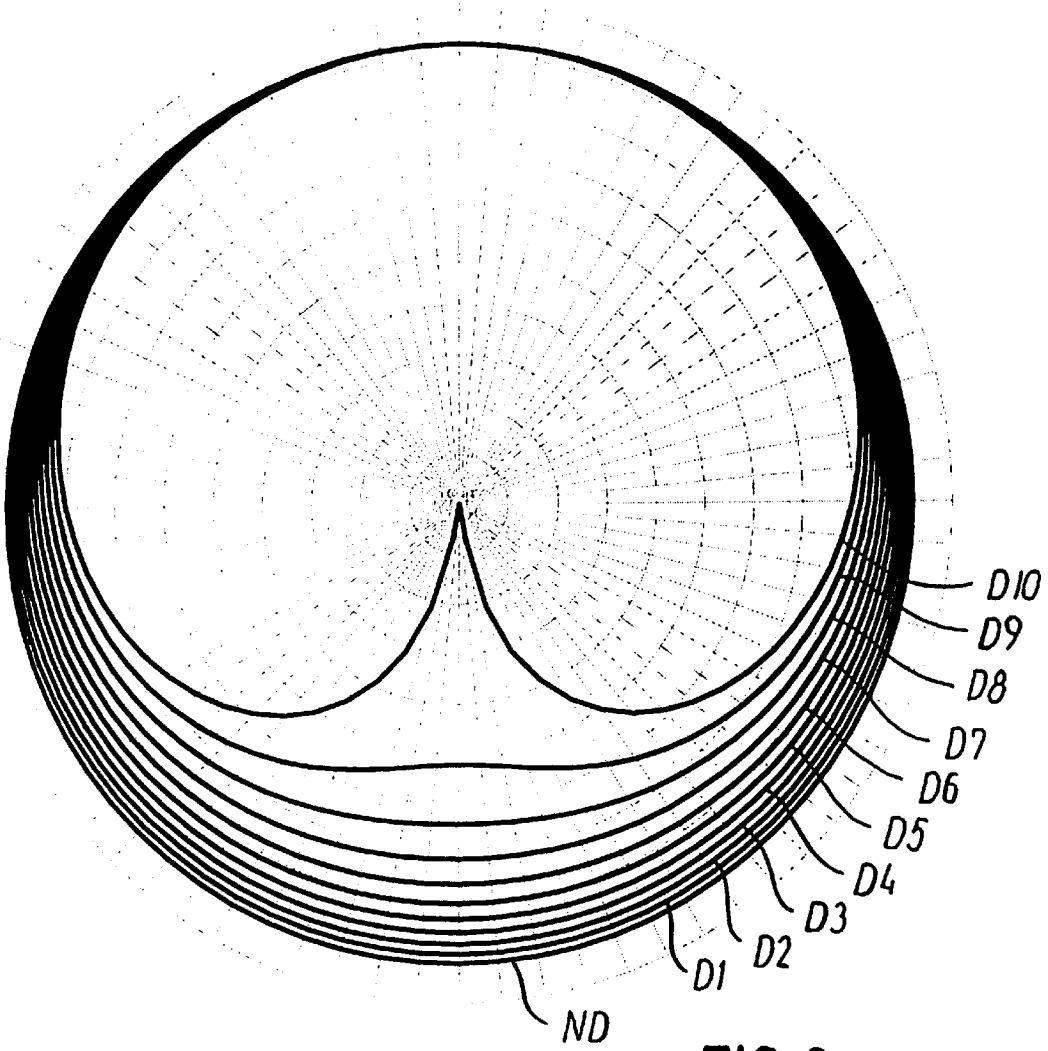
Figure 9:
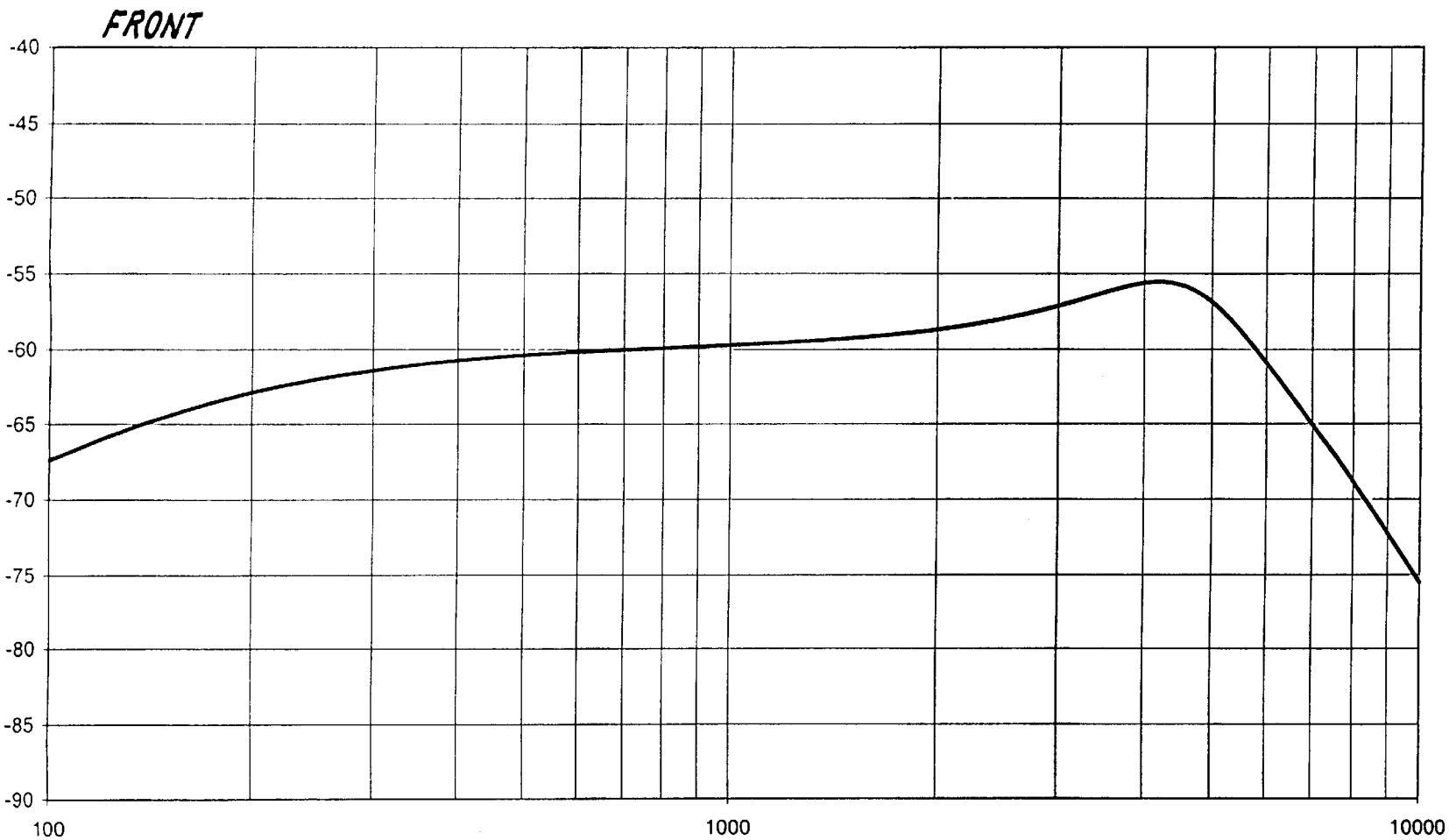
Figure 10:
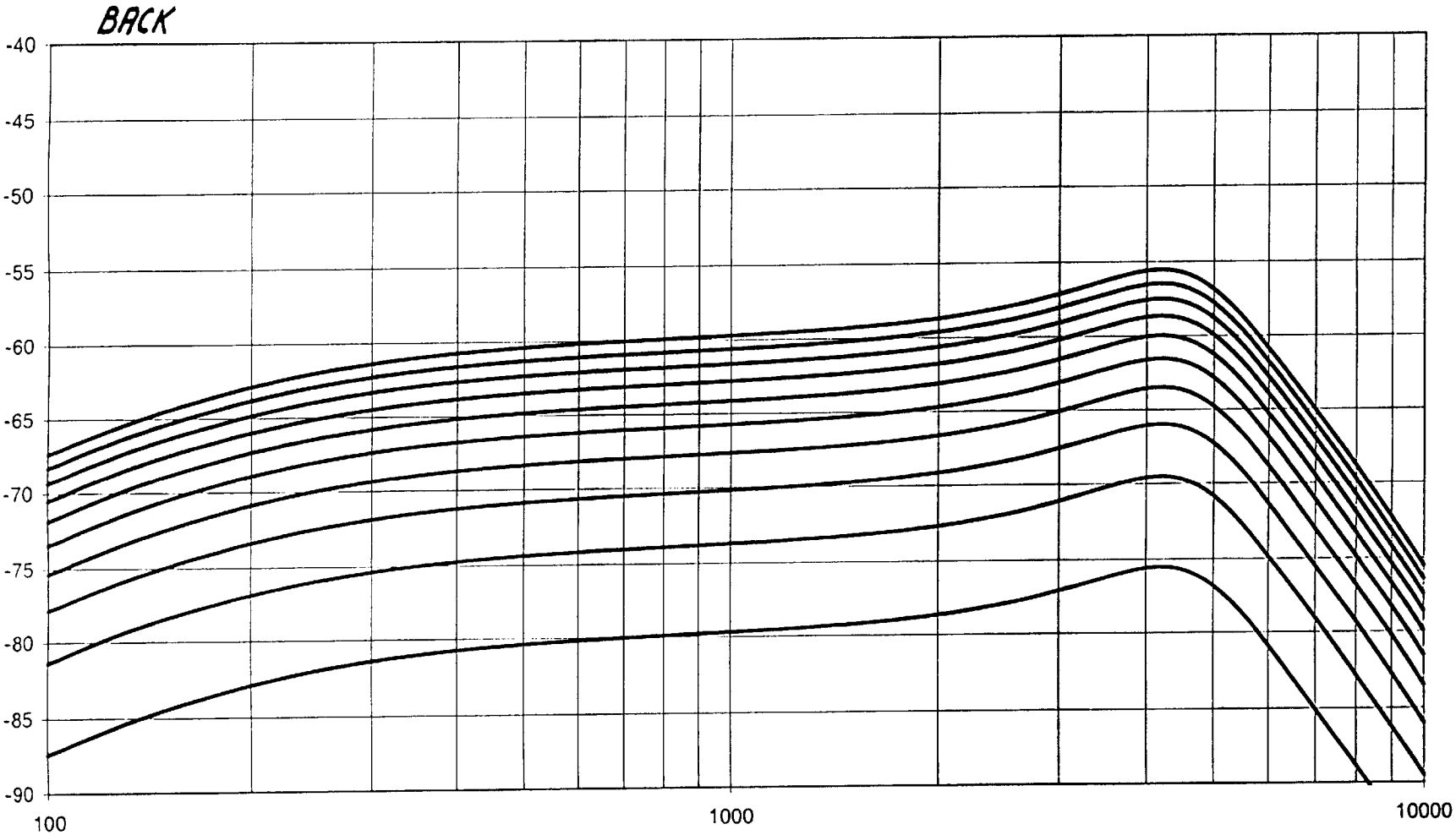

FIGS. 7 to 10 are graphic representations of sound receiving characteristics and amplitude response of a hearing aid embodying the front end part shown in FIG. 6 and corresponding to the representations in FIGS. 2 to 5 and using the same reference designations as in these figures, As will appear from FIGS. 7 and 8 the part of the sound receiving characteristic representing the area in front of the user is unaffected by the change over between the omnidirectional characteristic ND and the various directional shapes D1 to D10 and as illustrated by FIG. 9 the amplitude response of signals received from the area in front of the user is unaffected by the change over and remains the same irrespective of the change of the sound receiving characteristic to suppress sounds coming from the area behind the user. Thereby, the adjustment or fitting of the hearing aid to compensate for the user's hearing impairment in quiet surroundings, where the omnidirectional characteristic is used, will provide optimum listening performance also when the hearing aid is used in a more noisy environment using a directional shape of the sound receiving characteristic.

Figure 11:
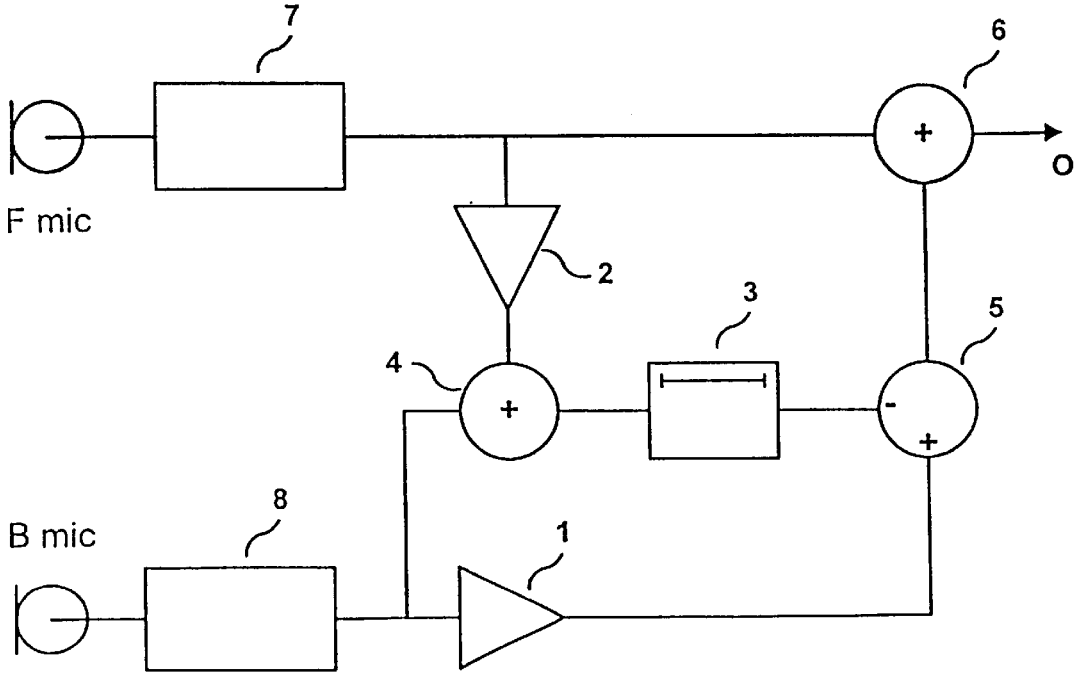
FIG. 11 shows a schematic arrangement of a second embodiment.

The circuit in FIG. 11 is similar to the circuit in FIG. 6 and includes a change-over controller with components 1 to 6. Similar components have been assigned the same reference numerals.

Additionally, signal processing units 7 and 8 are placed at the outputs of the at least two microphones, i.e. the front microphone Fmic and the back microphone Bmic. The processed output signals of the two signal processing units 7 and 8 are then supplied to the change-over controller with components 1 to 6. The signal processing units 7 and 8 may perform an equalizing function on the two output signals of the two microphones and/or may contain various filters, e.g. band pass filters. With the use of band pass filters the microphone signals may be split up into several bands, each equipped with its own change-over controller. The respective output signals from the adding circuits 6 in the various bands or channels may then be combined into a composite combined signal to be further processed in the remaining stages of the hearing aid.

Figure 12:
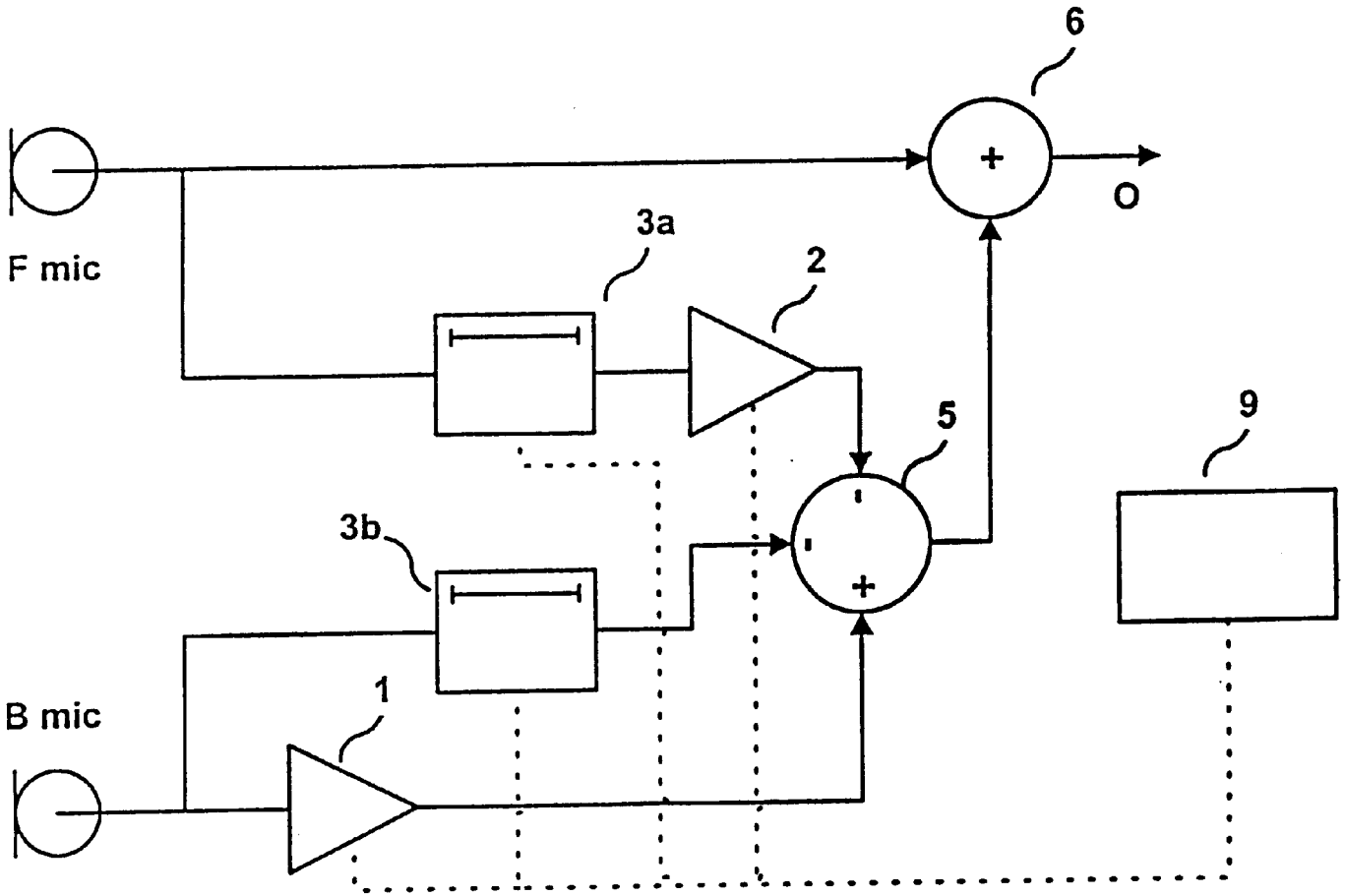
FIG. 12 shows a similar schematic arrangement of a third embodiment, FIG. 13 schematically shows a further improvement of the arrangement shown in FIG. 6.

FIG. 12 shows a similar circuit diagram of a third embodiment, so that for the same components the same reference numerals are used. In this circuit the time delay for the output signals of the two microphones Fmic and Bmic is effected in separate delay units 3*a* and 3*b* representing the delay device 3. Otherwise, the function is similar to the function of the circuits of FIGS. 6 and 11. Furthermore, a control unit 9 is shown, which may control the attenuation of the controllable attenuators 1 and 2 as well as the delays of delay units 3*a* and 3*b*. This embodiment of the invention is of special advantage in combination with microphone input circuits, which are capable of supplying a delayed microphone signal together with an undelayed microphone signal for a hearing aid. Such a circuit has been disclosed and described in applicants' copending International Patent Application PCT/EP99/00767.

As has been stated previously, it is of great importance that, in the change-over controller, the amplitude response as well as the time and phase of the audio signals are not changed when their directivity changes.

Figure 13:
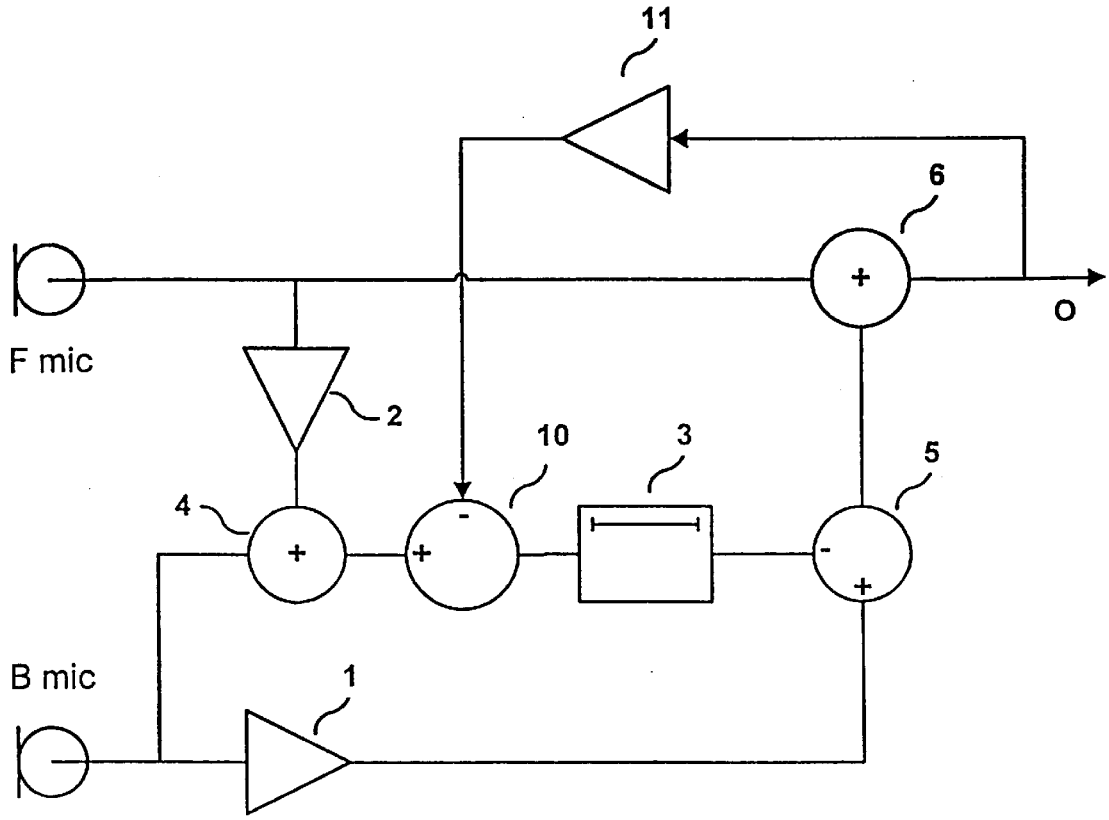

FIG. 13 schematically shows a further improvement of the front end circuit of a hearing aid including a change-over controller as described so far with reference to FIG. 6. Similar components have been designated with the same reference numerals as before.

Because of the technique used in combining the output signals of the two microphones Fmic and Bmic, the resulting amplitude response of the output signals of the adding means 6 will—of course—in the relevant frequency range—rise with 6 dB per octave compared to the amplitude response of a single microphone.

This behaviour may be observed in all systems, in which a delayed version of the output signal from the back microphone is subtracted from the undelayed output signal from the front microphone, while achieving a directional effect.

However, in most cases, it is desirable to compensate for this change in the amplitude response by adding a filter at the output of the front end of the hearing aid, i.e. at the adding circuit 6. Such a filter, of course, means a reduction of 6 dB per octave in the relevant frequency range. The drawback of such a solution is that more circuit components, time and power would be required, all of which are of very crucial importance in modern hearing aid technology.

However, the change-over controller of the present invention could also be adapted to, perform this compensation filtering. Therefore there will be no need to add a filter at the output of the adding circuit 6.

For this purpose an additional subtraction circuit 10 is arranged between the adding circuit 4 and the delay device 3, an the output signal of the adding circuit 6 is directly supplied to the negative input of adding means 10 in a feedback loop.

This new arrangement has already the desired effect.

It may be preferable to include a controllable amplifier or attenuator 11 into the feedback loop.

Thus, the output signal of the change-over controller is fed back from the adding circuit 6 via the controllable attenuator 11 to the negative input of subtraction circuit 10. Thus, the output signal of attenuator 11 is subtracted in the subtraction circuit 10 from the output signal of adding circuit 4.

The resulting output signal.of subtraction circuit 10 is supplied to the delay device 3 and hence to the negative input of the subtraction circuit 5, the positive input of which is connected to the output of the controllable attenuator 1.

In principle, in the embodiments in FIGS. 6 and 11 to 13 subtraction circuit 5 and adding circuit 6 could also be combined into a single combining circuit, provided this has, in every respect, the same properties as the two separate adding means 5 and 6.

Ideally, the gain factor of attenuator 11 should be one or unity for the filtering being able to perform the 6 dB per octave fall at very low frequencies. However, this would probably result in a loop gain of unity so that the circuit might become unstable. Therefore, it is preferred to have the gain of the amplifier or attenuator 11 set to a little less than one or unity.

Figure 14:
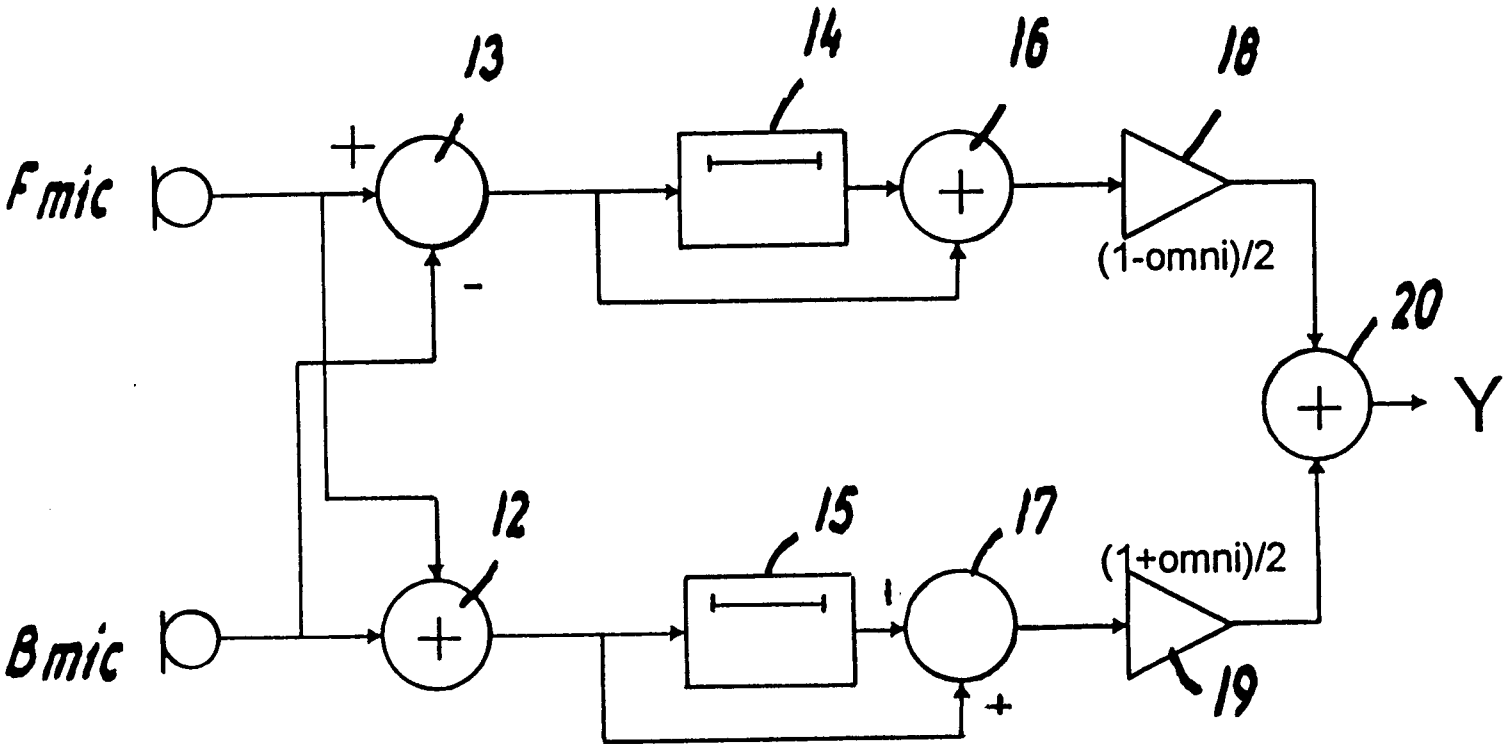
FIG. 14 shows a still further development of a hearing aid embodying the invention.

In FIG. 14 a further development of a hearing aid embodying the invention is shown, in which the controllable attenuation and phase delay operations, to which the signals from the front and back microphones Fmic and Bmic are subjected before forming the overall combined signal as represented by the relationship stated in the foregoing, i.e.

$$Y=X_{front}*(1-\text{omni}*e^{-j\omega T})+X_{back}*(\text{omni}-e^{-j\omega T})$$

are implemented by a different circuit structure

In this case, the change-over means comprises a first adding circuit 12 connected with the front and back microphones Fmic and Bmic and a first subtraction circuit 13 having a positive input connected with the front microphone Fmic and a negative input connected with the back microphone Bmic. First and second phase delay devices 14 and 15 are connected with the first subtraction and adding circuits 13 and 12, respectively. A second adding circuit 16 is connected with the first subtraction circuit 13 and the first phase delay device 14 and a second subtracting circuit 17 has its negative input connected with the first adding circuit 12 and its positive input connected with second phase delay device 15. A first controllable attenuator 18 acts on the signal from the second adding circuit 16 for attenuation of this signal by a factor (1−omni)/2 and a second controllable attenuator 19 acts on the signal from the second subtraction circuit 17 for attenuation of this signal by a factor (1+omni)/2, whereas a third adding circuit 20 is connected with the first and second attenuators 18 and 19 for addition of the signals therefrom to provide the overall combined signal to be supplied to the signal processor.

The microphones used in the described embodiments are preferably omnidirectional microphones.

When two microphones are used in the omnidirectional mode of operation, both microphones generate an electrical noise signal N. These two noise signals have a similar power:

$$|N_{back}|=|N_{front}|,$$

where $N_{back}$ is the noise signal from the back microphone Bmic, and $N_{front}$ is the noise signal from the front microphone Fmic.

The noise signals N are random signals. Therefore, the resulting signal amplitude is less than twice the single amplitude. Thus, a 3 dB-noise reduction results. The total noise signal can be calculated as:

$$|N|^2=|N_{front}|^2*|1-\text{omni}*e^{-j\omega T}|^2*+|N_{back}|^2*|1-\text{omni}*e^{-j\omega T}|^2\rightarrow|N|=|N_{front}*2^{0.5}|1-\text{omni}*e^{-j\omega T}|$$

It has been shown that with the new front end of a hearing aid comprising a change-over controller in accordance with the invention a great variety of directional characteristics patterns may be controllably realized.

What is claimed is:

1. A method for controlling the directionality of the sound receiving characteristic of a hearing aid having spaced apart first and second microphones, said first microphone providing a first microphone signal ($X_{front}$) and said second microphone providing a second microphone signal ($X_{back}$), a signal processor for processing said microphone signals and an output transducer for emission of sound signals in response to output signals from the signal processor, the method comprising the steps of selecting a control parameter omni to a value in the range from 0 to 1, selecting a time delay T, processing a signal derived from said first microphone signal by attenuation according to said parameter omni to provide a first processed signal, processing a signal derived from said second microphone signal by, attenuation according to said parameter omni to provide a second processed signal, adding said first processed signal to said second microphone signal to form a third processed signal, subjecting said third processed signal to said time delay to provide a fourth processed signal, subtracting said fourth processed signal from said second processed signal to provide a differential signal, adding said differential signal to said first microphone signal to provide an overall combined signal as determined by $$Y=X_{front}*(1-\text{omni}*e^{-j\omega T})+X_{back}*(\text{omni}-e^{-j\omega T}),$$

and feeding said overall combined signal to said signal processor.

2. The method according to claim 1, wherein said time delay is adjusted to a value equal to, or less than, the acoustical delay between said second microphone and said first microphone.

3. The method according to claim 1, comprising feeding-back said overall combined signal via a feedback loop to subtract it from said third processed signal and subjecting the resulting signal to, said time delay to provide said fourth processed signal.

4. The method according to claim 3, comprising attenuating the signal fed back in said feed-back loop.

5. The method according to claim 1, comprising performing a controlled gradual change of said parameter omni from zero to one.

6. The method according to claim 1, comprising controlling said time delay from 1 $\mu$s to 1000 $\mu$s.

7. A method for controlling the directionality of the sound receiving characteristic of a hearing aid having spaced apart first and second microphones, said first microphone providing a first microphone signal ($X_{front}$) and said second microphone providing a second microphone signal ($X_{back}$), a signal processor for processing said microphone signals and an output transducer for emission of sound signals in response to output signals from the signal processor, said method comprising the steps of selecting a control parameter omni to a value in the range from 0 to 1, selecting a time delay T, subjecting a signal derived from said first microphone signal to said time delay and to attenuation according to said parameter omni to provide a first processed signal, processing a signal derived from said second microphone signal by attenuation according to said parameter omni to provide a second processed signal, subjecting a signal derived from said second microphone signal to said time delay to output a third processed signal, subtracting said first processed signal and said third processed signal from said second processed signal to provide a fourth processed signal, adding said fourth processed signal to said first microphone signal to provide an overall combined signal as determined by $$Y=X_{front}*(1-\text{omni}*e^{-j\omega T})+X_{back}*(\text{omni}-e^{-j\omega T}),$$

and feeding said overall combined signal to said signal processor.

8. The method according to claim 7, wherein said time delay is adjusted to a value equal to, or less than, the acoustical delay between said second microphone and said first microphone.

9. The method according to claim 7, comprising feeding-back said overall combined signal via a feedback loop to subtract it from said third processed signal and subjecting the resulting signal to said time delay to provide said fourth processed signal.

10. The method according to claim 9, comprising attenuating the signal fed back in said feed-back loop.

11. The method according to claim 7, comprising performing a controlled gradual change of said parameter omni from zero to one.

12. The method according to claim 7, comprising controlling said time delay from 1 $\mu$s to 1000 $\mu$s.

13. A method for controlling the directionality of the sound receiving characteristic of a hearing aid having spaced apart first and second microphones, said first microphone providing a first microphone signal ($X_{front}$) and said second microphone providing a second microphone signal ($X_{back}$), a signal processor for processing said microphone signals and an output transducer for emission of sound signals in response to output signals from the signal processor, said method comprising the steps of selecting a control parameter omni to a value in the range from 6 to 1, selecting a time delay T, feeding signals from said first and second microphones to a first subtracting means to provide a differential signal equivalent to said first microphone signal minus said second microphone signal, feeding signals from said first and second microphones to a first adding means to provide a sum signal equivalent to the sum of said first microphone signal and said second microphone signal, subjecting said differential signal to said time delay and adding the delayed signal to the differential signal to provide a first processed signal, attenuating said first processed signal by a factor (1−omni)/2 to provide a second processed signal, subjecting said sum signal to said time delay and adding the delayed signal to the sum signal to provide a third processed signal, attenuating said third processed signal by a factor (1+omni)/2 to provide a fourth processed signal, and adding together said second and said fourth processed signals to provide an overall combined signal as determined by $$Y=X_{front}*(1-\text{omni}*e^{-j\omega T})+X_{back}*(\text{omni}-e^{-j\omega T}),$$

and feeding said overall combined signal to said signal processor.

14. The method according to claim 13, wherein said time delay is adjusted to a value equal to, or less than, the acoustical delay between the back microphone and the front microphone.

15. The method according to claim 13, comprising performing a controlled gradual change of said parameter omni from zero to one.

16. The method according to claim 13, comprising controlling said time delay from 1 $\mu$s to 1000 $\mu$s.

17. A hearing aid with spaced apart first and second microphones, said first microphone providing a first microphone signal ($X_{front}$) and said second microphone providing a second microphone signal ($X_{back}$), a signal processor for processing said microphone signals and an output transducer for emission of sound signals in response to output signals from the signal processor, comprising controllable attenuation means and controllable time delay means acting on signals derived from the signals from both of the first and second microphones, respectively, to provide a processed signal, combining means for combining said processed signal with said first and second microphone signals to provide an overall combined signal supplied to the signal processor, and change-over control means for effecting a change-over of the sound receiving characteristic between an omnidirectional mode and a directional mode, wherein said change-over control means is adapted for controlling said attenuation means and said time delay means for forming said overall combined signal (Y) according to an adjustable attenuation control parameter (omni) and a delay (T), whereby said overall combined signal (Y) is determined by $$Y=X_{front}*(1-\text{omni}*e^{-j\omega T})+X_{back}*(\text{omni}-e^{-j\omega T}).$$

18. The hearing aid according to claim 17, wherein said attenuation means comprises first and second attenuator means, the output of said first attenuator means being connected to said time delay means, the output of said time delay means being connected to a negative input of subtraction means having a positive input connected with said second attenuator means, the output signals of said subtraction means and said first microphone means being connected with combining means to provide said overall combined signal.

19. The hearing aid according to claim 18, wherein the output of said first attenuator means is connected with a first input of adding means having a second input connected with the second microphone means, the output of said adding means being connected with said time delay means.

20. The hearing aid according to claim 17, wherein said time delay means comprises separate first and second delay units connected with the first and second microphone means, respectively, said attenuation means comprising first attenuator means connected between said first delay unit and said subtraction means.

21. The hearing aid according to claim 19, wherein the output of said combining means providing said overall combined signal is connected via a feedback loop with a negative input of subtracting means having a positive input connected with the output of said adding means.

22. The hearing aid according to claim 21, wherein a third attenuator means is included in said feedback loop.

23. The hearing aid according to claim 17, wherein said change-over means comprises a first adding circuit connected with the first and second microphone means and a first subtraction circuit having a positive input connected with said first microphone means and a negative input connected with said second microphone means, a first time delay device connected with the output of the first subtraction circuit, a second time delay device connected with the output of the first adding circuit, a second adding circuit for addition of the signals provided by said first subtraction circuit and by said first time delay device, a second subtraction circuit having a positive input connected with the first adding circuit and a negative input connected with the second time delay device, a first controllable attenuator subjecting the signal from the second adding circuit to attenuation by a factor (1−omni)/2, a second controllable attenuator subjecting the signal from the second subtraction circuit to attenuation by a factor (1+omni)/2 and a third adding circuit for addition of the signals from said first and second attenuators to provide said overall combined signal.

24. The hearing aid according to claim 17, wherein said adjustable parameter (omni) is substantially the same for the attenuation of both of the derived signals and has a value in the range $0 \leqq \text{omni} \leqq 1$.

25. The hearing aid according to claim 17, wherein the time delay is adjusted to a value equal to, or less than, the acoustical delay between the back microphone and the front microphone.

26. A directional controller for a hearing aid for processing input signals from at least two spaced apart microphones for producing a combined output signal for further processing in the hearing aid, the directional controller comprising a first controllable attenuator for processing a signal derived from the signal from the first microphone to output a first processed signal, a second controllable attenuator for processing a signal derived from the signal from the second microphone to output a second processed signal, time delay means for delaying signals derived from the signals from both of the first and the second microphones and combining means connected to combine the processed and delayed signals with the output signal from the first microphone to generate said combined output signal, said change-over control means being connected to control the controllable attenuators for effecting a change-over between an omnidirectional mode and a directional mode.

27. The directional controller in accordance with claim 26, wherein the first controllable attenuator comprises a controllable amplifier.

28. The directional controller in accordance with claim 26, wherein the second controllable attenuator comprises a controllable amplifier.

29. The directional controller in accordance with claim 26, wherein the control unit is adapted for controlling the delay of the delay means.

30. The directional controller in accordance with claim 26, wherein the combining means comprises a first adding means connected to combine the output signal from the first controllable attenuator with the output signal from the second microphone to output a signal for processing in the delay means for the generation of a combined processed signal, which combined processed signal is supplied to a second adding means for combination with the second processed signal.

31. The directional controller in accordance with claim 30, comprising a fourth adding means arranged in front of the delay device and connected via a feed-back loop to subtract the combined output signal from the signal outputted from the first adding means.

32. The directional controller in accordance with claim 31, comprising a controllable amplifier arranged to process the output signal fed to the fourth adding means.

33. The directional controller in accordance with claim 32, wherein the controllable amplifier is adapted to provide a gain, which is somewhat less than unity.

34. The directional controller in accordance with claim 26, wherein the delay means comprises separate first and second delay units for receiving output signals from the first and second microphones, respectively, the first delay device supplying a delayed output signal to the first controllable attenuator, a first adding means being connected to receive the first processed signal along with the output signal from the second delay unit at respective negative inputs and, at a positive input, the second processed signal.

35. The directional controller in accordance with claim 26, wherein the change-over means comprises a first adding circuit connected with said first and said second microphones, a first subtraction circuit having a positive input connected with said first microphone and a negative input connected with said second microphone, a first delay device connected with the output of the first subtraction circuit, a second delay device connected with the output of the first adding circuit, a second adding circuit connected with the first subtraction circuit and the first delay device, a second subtraction circuit having its positive input connected with the first adding circuit and its negative input connected with second delay device, a first controllable attenuator acting on the signal from the second adding circuit for attenuating this signal by a factor (1−omni)/2 and a second controllable attenuator acting on the signal from the second subtraction circuit for attenuating this by a factor (1+omni)/2, and a third adding circuit connected with the first and second attenuators for adding the signals therefrom to provide said combined output signal.

* * * * *

UNITED STATES PATENT AND TRADEMARK OFFICE

CERTIFICATE OF CORRECTION

PATENT NO. : 6,704,422 B1
DATED : March 9, 2004
INVENTOR(S) : Lars Baekgaard Jensen It is certified that error appears in the above-identified patent and that said Letters Patent is hereby corrected as shown below:

Title page,
Item [56], References Cited, U.S. PATENT DOCUMENTS, insert
-- 5,473,701 A 12/1995 Cezanne et al --

Signed and Sealed this

Twenty-eighth Day of June, 2005

JON W. DUDAS
*Director of the United States Patent and Trademark Office*